US010264335B1

(12) United States Patent
Ren et al.

(10) Patent No.: US 10,264,335 B1
(45) Date of Patent: Apr. 16, 2019

(54) SPEAKER BOX AND METHOD FOR ASSEMBLING SAME

(71) Applicant: AAC Technologies Pte. Ltd., Singapore (SG)

(72) Inventors: Zhang Ren, Shenzhen (CN); YuGuo Zhang, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 16/055,077

(22) Filed: Aug. 4, 2018

(30) Foreign Application Priority Data

Dec. 21, 2017 (CN) ..... 2017 1 1394040

(51) Int. Cl.

| | |
|---|---|
| ***H04R 1/00*** | (2006.01) |
| ***H04R 1/02*** | (2006.01) |
| ***H04R 1/28*** | (2006.01) |
| *H04R 9/06* | (2006.01) |

(52) U.S. Cl.
CPC ..... *H04R 1/02* (2013.01); *H04R 1/2803* (2013.01); *H04R 9/06* (2013.01); *H04R 2400/11* (2013.01); *H04R 2499/11* (2013.01)

(58) Field of Classification Search
CPC ..... H04R 1/02; H04R 1/021; H04R 1/025; H04R 1/2811; H04R 1/2888
See application file for complete search history.

(56) References Cited

U.S. PATENT DOCUMENTS

| | | | | |
|---|---|---|---|---|
| 6,763,110 | B1 * | 7/2004 | Sung | H04M 1/0202 379/433.02 |
| 8,885,867 | B1 * | 11/2014 | Tai | H04R 1/345 381/333 |
| 9,479,850 | B2 * | 10/2016 | Lee | H04M 1/035 |
| 2001/0009586 | A1 * | 7/2001 | Suzuki | H04R 1/2811 381/151 |
| 2002/0187758 | A1 * | 12/2002 | Ylitalo | H01Q 1/242 455/575.1 |
| 2007/0116321 | A1 * | 5/2007 | Jang | H04M 1/035 381/388 |
| 2009/0291718 | A1 * | 11/2009 | Fukazawa | H04M 1/03 455/575.1 |
| 2012/0275637 | A1 * | 11/2012 | Liao | H04R 1/025 381/395 |
| 2013/0070947 | A1 * | 3/2013 | Chien | H04R 1/2803 381/332 |
| 2013/0070956 | A1 * | 3/2013 | Yamanaka | H04R 1/025 381/433 |
| 2014/0023223 | A1 * | 1/2014 | Hwang | H04R 1/025 381/386 |

(Continued)

*Primary Examiner* — Matthew A Eason
(74) *Attorney, Agent, or Firm* — Na Xu; IPro, PLLC

(57) ABSTRACT

The present application discloses a speaker box. The speaker box includes an upper cover, a lower cover forming an accommodation space with the upper cover, and a speaker received in the accommodation space. The speaker includes a frame and a diaphragm positioned by the frame. The upper cover forms a supporting wall extending toward the lower cover for fixing the speaker. The speaker box further includes an elastic cushion arranged between the frame and the supporting wall. A method for assembling the speaker box is also provided. Due to the elastic cushion, the consistency of the speaker is ensured, and the acoustic performance of the speaker box is accordingly improved.

7 Claims, 2 Drawing Sheets

(56) References Cited

U.S. PATENT DOCUMENTS

| | | | | |
|---|---|---|---|---|
| 2014/0193024 | A1* | 7/2014 | Raff | H04R 1/02 381/394 |
| 2014/0294225 | A1* | 10/2014 | Ji | H04R 1/023 381/386 |
| 2014/0301587 | A1* | 10/2014 | Ji | H04R 1/025 381/332 |
| 2016/0165327 | A1* | 6/2016 | Crosby | H04R 1/2811 381/332 |
| 2016/0225362 | A1* | 8/2016 | Xu | G10K 11/002 |
| 2016/0227304 | A1* | 8/2016 | Xu | H04R 7/20 |
| 2016/0227314 | A1* | 8/2016 | Cai | H04R 1/2888 |
| 2016/0295316 | A1* | 10/2016 | Shao | H04R 1/025 |
| 2016/0323675 | A1* | 11/2016 | Dai | H04R 9/06 |
| 2017/0055065 | A1* | 2/2017 | Zhang | H04R 1/2803 |
| 2017/0208386 | A1* | 7/2017 | Yang | H04R 1/22 |

* cited by examiner

SPEAKER BOX AND METHOD FOR ASSEMBLING SAME

FIELD OF THE PRESENT DISCLOSURE

This disclosure related to the field of electro-acoustic transducers, and more particularly to a speaker box used in a portable electronic device, like a mobile phone.

DESCRIPTION OF RELATED ART

A mobile phone is more and more popular in day life. As one important feature of a mobile phone, music play-back is one of the concerns for a user to choose a phone. A speaker box is a component, or a transducer to convert electrical signals to audible sounds (music).

A related speaker box includes an upper cover, a lower cover forming an accommodation space together with the upper cover, a speaker accommodated in the accommodation space, and a sound passageway communicating with the accommodation space. The upper cover forms a supporting wall for fixing the speaker, and a front sound cavity is formed between the speaker and the upper cover. The sound passageway forms a front cavity cooperatively with the front sound cavity. Generally, the speaker is fixed to the supporting wall only by adhesive. Due to the poor consistency of the adhesive layer between the speaker and the supporting wall, the acoustic performance of the speaker is badly affected. In addition, during dropping, the speaker collides the supporting wall, which would separates the internal component, such as the magnet, of the speaker from other components.

Therefore it is necessary to provide an improved miniature speaker for overcoming the above-mentioned disadvantages.

BRIEF DESCRIPTION OF THE DRAWINGS

Many aspects of the exemplary embodiment can be better understood with reference to the following drawing. The components in the drawing are not necessarily drawn to scale, the emphasis instead being placed upon clearly illustrating the principles of the present disclosure.

DETAILED DESCRIPTION OF THE EXEMPLARY EMBODIMENT

The present disclosure will hereinafter be described in detail with reference to an exemplary embodiment. To make the technical problems to be solved, technical solutions and beneficial effects of the present disclosure more apparent, the present disclosure is described in further detail together with the figure and the embodiment. It should be understood the specific embodiment described hereby is only to explain the disclosure, not intended to limit the disclosure.

Figure 1:
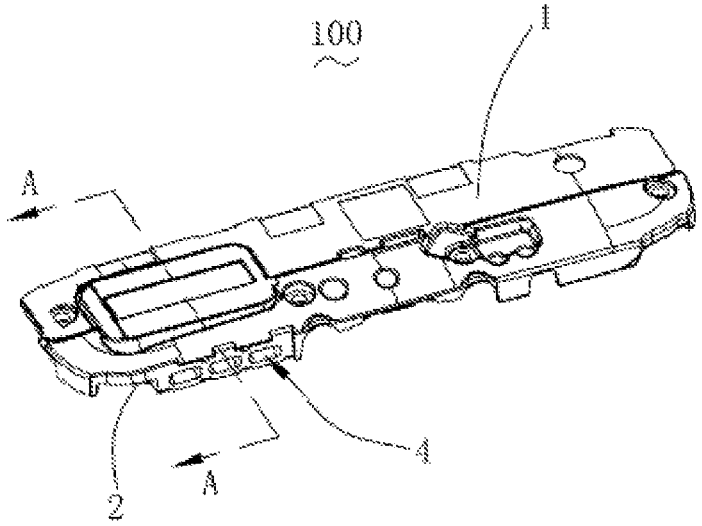
FIG. 1 is an isometric view of a speaker box in accordance with an exemplary embodiment of the present invention.
Figure 2:
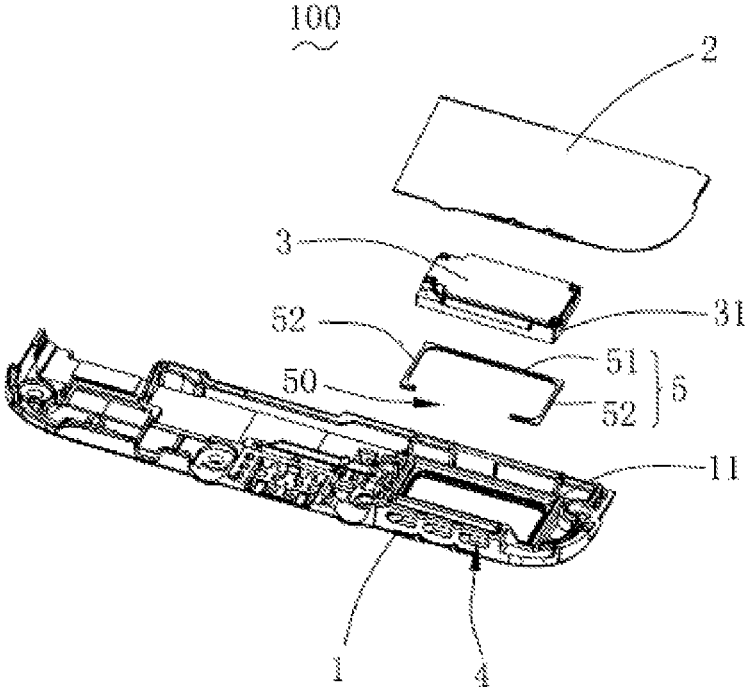
FIG. 2 is an isometric and exploded view of the speaker box in FIG. 1.
Figure 3:
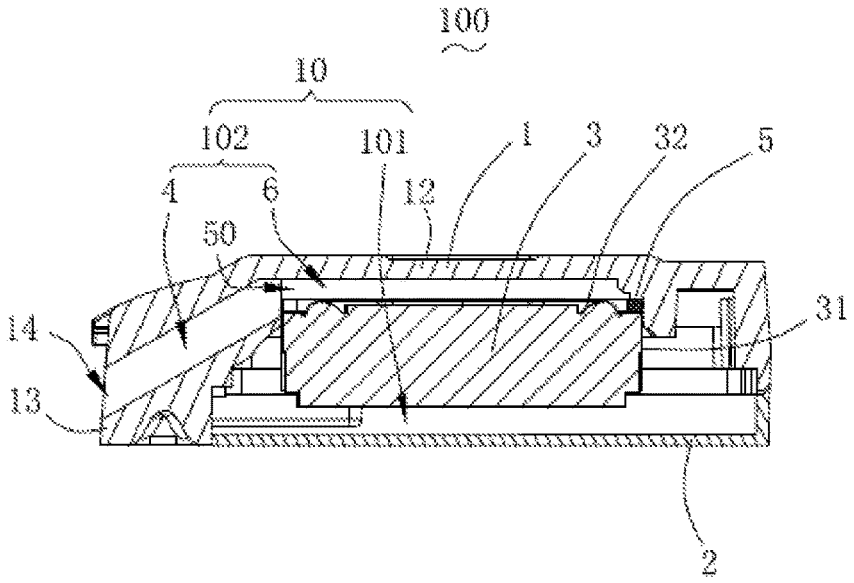
FIG. 3 is a cross-sectional view of the speaker box taken along line A-A in FIG. 1.

Referring to FIGS. 1-3, an exemplary embodiment of the present invention discloses a speaker box 100 including an upper cover 1, a lower cover 2, an accommodation space 10 formed cooperatively by the upper cover 1 and the lower cover 2, a speaker 3 accommodated in the accommodation space 10, a sound passageway 4, and an elastic cushion 5. The upper cover 1 can be formed integrally with the lower cover 2, or connected with the lower cover 2. The upper cover 1 further includes a supporting wall 11 extending toward the lower cover 2 for fixing the speaker 3.

The speaker 3 includes a frame 31 and a diaphragm 32 positioned by the frame, and the speaker 3 is fixed to the supporting wall 11 by connecting a side adjacent to the diaphragm 32 with the supporting wall 11. The side adjacent to the diaphragm 32 is defined as a sound radiation side. Further, the speaker 3 divides the accommodation space 10 into a front sound cavity 6 and a rear cavity 101. In other words, the front sound cavity 6 is formed by the speaker 3 and the upper cover 1 for radiating sound, and the rear cavity 101 is formed cooperatively by the upper cover 1, the lower cover 2 and the speaker 3. Low frequency acoustic performance is accordingly improved.

The sound passageway 4 is formed in the accommodation space 10. Specifically, the sound passageway 4 is formed in the upper cover 1. The sound passageway 4 and the front sound cavity 6 cooperatively form a front cavity 102 for communicating the front sound cavity 6 with outside of the speaker box 1.

The elastic cushion 5 is arranged between the supporting wall 11 and the frame 31. Preferably, an edge of the diaphragm 32 and the elastic cushion 5 are sandwiched between the supporting wall 11 and the frame 31. The elastic cushion 5 is, optionally, made from silica gel. The upper cover 1 comprises a base 12 facing towards and spaced apart from the speaker 3, and a side wall 13 extending from the base 12 to the lower cover 2, the side wall 12 cooperatively fixed to the lower cover 2 to form the accommodation space 10, with the front sound cavity 6 formed between the speaker and the base 12; the sound passageway 4 runs through the side wall 13, with a sound hole 14 formed on the side wall 13, the sound passageway 4 communicates with the front sound cavity 6; the elastic cushion 5 extends along an edge of the frame 31 with a notch 50 corresponding to the passageway 4, the passageway 4 communicating with the front sound cavity 6 through the notch 50. The elastic cushion 5 is C-shaped. The elastic cushion 5 comprises a first arm 51 opposite to the sound passageway 4, and two second arms 52 separately extending from two opposite ends of the first arm 51 towards the sound passageway 4, and the two second arms 52 are spaced apart from each other, with the notch 50 formed between the two second arms 52.

In the exemplary embodiment, the elastic cushion 5 is attached to the edge of the diaphragm 32, which ensures the consistency of the engagement for further improving the acoustic performance of the speaker box 100. The speaker 3 is attached to the supporting wall 11 by abutting the elastic cushion 5 against the supporting wall 11 for forming a buffering structure. During dropping, the elastic cushion 5 protects the speaker 3 from colliding, by which the internal components inside the speaker 3 are also protected. Stability of the speaker box 100 is ensured accordingly.

Figure 4:
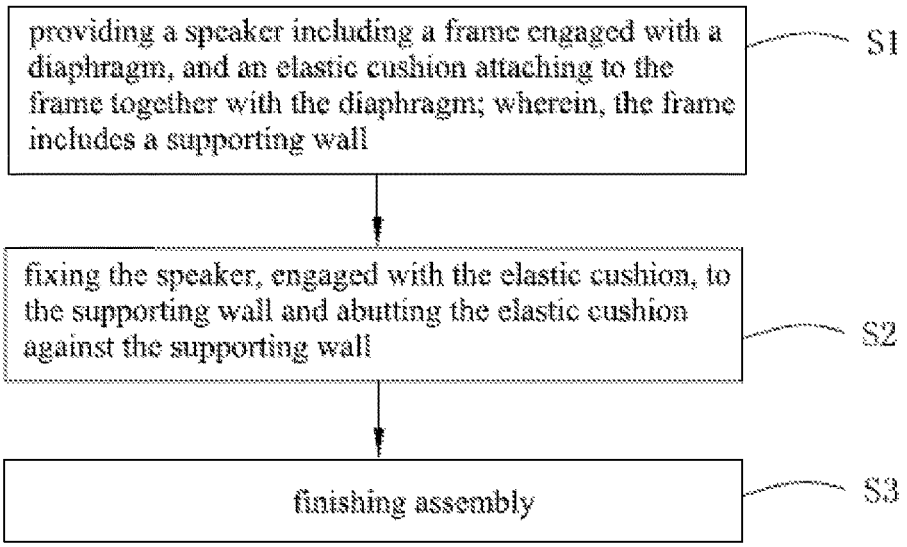
FIG. 4 is a flow chart of a method for assembling the speaker box in FIG. 1.

Referring to FIG. 4, a method for assembling the speaker box 100 is also disclosed. The method includes steps as follows:

Step S1: providing a speaker including a frame engaged with a diaphragm, and an elastic cushion attaching to the frame together with the diaphragm; wherein, the frame includes a supporting wall, and before engagement, the elastic cushion and the diaphragm are both provided with extra width for conveniently attaching to each other;

Step S2: fixing the speaker, engaged with the elastic cushion, to the supporting wall and abutting the elastic cushion against the supporting wall;

Step S3: finishing the assembly.

The elastic cushion is attached to the edge of the diaphragm, which ensures the consistency of the engagement for further improving the acoustic performance of the speaker box. The speaker is attached to the supporting wall by abutting the elastic cushion against the supporting wall for forming a buffering structure. During dropping, the elastic cushion protects the speaker from colliding, by which the internal components inside the speaker 3 are also protected. Stability of the speaker box is ensured accordingly.

It is to be understood, however, that even though numerous characteristics and advantages of the present exemplary embodiment have been set forth in the foregoing description, together with details of the structures and functions of the embodiment, the disclosure is illustrative only, and changes may be made in detail, especially in matters of shape, size, and arrangement of parts within the principles of the invention to the full extent indicated by the broad general meaning of the terms where the appended claims are expressed.

What is claimed is:

1. A speaker box, including:

a lower cover;

an upper cover;

an accommodation space formed cooperatively by the upper cover and the lower cover;

a supporting wall extending from the upper cover toward the lower cover;

a speaker accommodated in the accommodation space and fixed to the supporting wall, the speaker including a frame and a diaphragm positioned to the frame;

an elastic cushion arranged between the frame and the supporting wall; wherein a side of the frame adjacent to the diaphragm is fixed to the supporting wall;

the upper cover comprises a base facing towards and spaced apart from the speaker, and a side wall extending from the base to the lower cover, the side wall cooperatively fixed to the lower cover to form the accommodation space, with a front sound cavity formed between the speaker and the base;

a sound passageway runs through the side wall, with a sound hole formed on the side wall, the sound passageway communicates with the front sound cavity;

the elastic cushion extends along an edge of the frame with a notch corresponding to the passageway, the passageway communicating with the front sound cavity through the notch.

2. The speaker box as described in claim 1, wherein the elastic cushion is made from silica gel.

3. The speaker box as described in claim 1, wherein the elastic cushion engages with an edge of the diaphragm.

4. A method for assembling the speaker box as described in claim 1, including the steps of:

providing a speaker including a frame engaged with a diaphragm, and an elastic cushion attaching to the frame together with the diaphragm; wherein, the frame includes a supporting wall;

fixing the speaker, engaged with the elastic cushion, to the supporting wall and abutting the elastic cushion against the supporting wall.

5. The method as described in claim 4, wherein before engagement, the elastic cushion and the diaphragm are both provided with extra width for conveniently attaching to each other.

6. The speaker box as described in claim 1, wherein the elastic cushion is C-shaped.

7. The speaker box as described in claim 1, wherein the elastic cushion comprises a first arm opposite to the sound passageway, and two second arms separately extending from two opposite ends of the first arm towards the sound passageway, and the two second arms are spaced apart from each other, with the notch formed between the two second arms.

* * * * *